United States Patent [19]

Smith, Jr.

[11] Patent Number: 4,966,722

[45] Date of Patent: Oct. 30, 1990

[54] OIL ADDITIVE COMPOSITIONS EXHIBITING REDUCED HAZE CONTAINING POLYMERIC VISCOSITY INDEX IMPROVER

[75] Inventor: Marvin F. Smith, Jr., Aberdeen, N.J.

[73] Assignee: Exxon Chemical Patents Inc., Linden, N.J.

[21] Appl. No.: 271,695

[22] Filed: Nov. 16, 1988

[51] Int. Cl.[5] ..... C10M 161/00

[52] U.S. Cl. ..... 252/56 R; 585/12

[58] Field of Search ..... 252/56 R; 585/12

[56] References Cited

U.S. PATENT DOCUMENTS

| | | | |
|---|---|---|---|
| 4,069,162 | 1/1978 | Gardiner et al. | 585/12 |
| 4,146,492 | 3/1979 | Cusano et al. | 252/56 R |
| 4,507,515 | 3/1985 | Johnston et al. | 585/12 |
| 4,620,048 | 10/1986 | Ver Strate et al. | 252/56 R |
| 4,707,285 | 11/1987 | Brewster et al. | 252/56 R |
| 4,804,794 | 2/1989 | Ver Strate et al. | 585/12 |

*Primary Examiner*—Jacqueline V. Howard
*Attorney, Agent, or Firm*—M. B. Kapustij

[57] ABSTRACT

Oil compositions comprising a lubricating oil and oil-soluble ethylene-alpha-olefin copolymer viscosity index improvers are substantially haze-free when said compositions contain an anti-hazing effective amount of a hydrocarbyl substituted succinic acid. The ethylene-alpha-olefin copolymer comprises intramolecularly heterogeneous and intermolecularly homogeneous copolymer chains containing at least one crystallizable segment of methylene units and at least one low crystallinity ethylene-alpha-olefin copolymer segment, wherein said at least one crystallizable segment comprises at least about 10 weight percent of said copolymer chain and contains at least about 57 weight percent ethylene, wherein said low crystallinity segment contains not greater than about 53 weight percent ethylene, and wherein said copolymer has a molecular weight distribution characterized by at least one of a ratio of $\overline{M}_w/\overline{M}_n$ of less than 2 and a ratio of $\overline{M}_z/\overline{M}_w$ of less than 1.8, and wherein at least two portions of an individual intramolecularly heterogeneous chain, each portion comprising at least 5 weight percent of said chain, differ in composition from one another by at least 7 weight percent ethylene. The invention also relates to the process for preparing said compositions.

64 Claims, No Drawings

OIL ADDITIVE COMPOSITIONS EXHIBITING REDUCED HAZE CONTAINING POLYMERIC VISCOSITY INDEX IMPROVER

BACKGROUND OF THE INVENTION

1. Field of the Invention

This invention relates to viscosity index improver containing oil compositions, particularly lubricating oil compositions, exhibiting reduced haze, and to a process for preparing such compositions. In particular, this invention is directed to low-haze or substantially haze-free lubricating oil compositions and additive packages used in their formulation containing ethylene-propylene copolymer viscosity index improvers and a haze-reducing effective amount of an oil-soluble hydrocarbyl substituted succinic acid.

2. Description of the Prior Art

An important property of a lubricating composition is the rate at which its viscosity changes as a function of temperature. The relationship between the viscosity and temperature is commonly expressed as the viscosity index (V.I.) Lubricant compositions which change little in viscosity with variations in temperature have a greater viscosity index than do compositions whose viscosity is materially affected by changes in temperature. One of the major requirements of the lubricating oils is a satisfactory viscosity-temperature characteristic so that the oils will not lose their fluidity but will show an equally good performance within a relatively wide temperature range to which they may be exposed in service.

In addition to refining natural petroleum oils to improve their viscosity index characteristics, it has been common practice to introduce long chain hydrocarbon compounds such as linear polymers in order to raise the viscosity index of lubricant compositions. Among the V.I. improvers that have been described in the patent literature are polyisobutylenes as taught in U.S. Pat. Nos. 2,084,501 and 2,779,753; polyalkylmethacrylates as described in U.S. Pat. No. 3,607,749; copolymers of alkylmethacrylates and styrene as shown in U.S. Pat. No. 3,775,329; hydrogenated butadienestyrene copolymers as shown in U.S. Pat. No. 2,798,853; and copolymers of butadiene, styrene and isoprene as shown in U.S. Pat. No. 3,795,615. It is also known to utilize ethylene-alpha-olefin copolymers such as ethylene-propylene copolymers as viscosity index improvers. A particularly useful type of ethylene-alpha-olefin copolymers are described in U.S. patent application Ser. No. 72,825, filed July 13, 1987. These copolymers are segmented copolymers of ethylene and at least one other alpha-olefin monomer; each copolymer is intramolecularly heterogeneous and intermolecularly homogeneous and at least one segment of the copolymer, constituting at least 10% of the copolymer's chain, is a crystallizable segment. The term "crystallizable segment" is defined to be each segment of the copolymer chain having a number-average molecular weight of at least 700 wherein the ethylene content is at least 55 wt. %. The remaining segments of the copolymer chain are herein termed the "low crystallinity segments" and are characterized by an average ethylene content of not greater than about 53 wt. %. Furthermore, the molecular weight distribution (MWD) of copolymer is very narrow.

However, during the preparation, processing, and/or storage of these oil soluble ethylene-alpha-olefin copolymers a haze may develop in their oil concentrates or oil compositions (e.g., oil concentrates or final oil formulations containing the ethylene-alpha-olefin copolymers). The source of this haze does not appear to be the same as that haze resulting from incompatibility of the several additives in a lubricating oil additive concentrate or composition (see U.S. Pat. No. 3,897,353 wherein haze resulting from component incompatibility is overcome in a lubricating oil additive concentrate by blending an amorphous ethylene-propylene copolymer with an n-alkyl methacrylate containing polymer having a number average molecular weight between about 30,000 and about 120,000). Rather, it is believed that this haze is due to the presence of a wide variety of catalysts, metal weak acid salts, etc. which are used in or result from the by-product of the polymerization, finishing process, or other steps in the manufacture or finishing of the ethylene-alpha olefin copolymers of this invention or their oil concentrates. Thus, for example, a typical haze producing substance is calcium stearate having a particle size of from about 0.01 microns to about 15 microns, which calcium stearate is used in the finishing process of these ethylene-alpha-olefin copolymers useful as V.I. improvers. Generally, oil compositions such as oil concentrates containing these ethylene-alpha-olefin copolymer viscosity index improvers also contain a haze forming amount of these metal weak acid salts. These haze forming amounts are generally less than about 1 wt. % based on the total weight of the oil compositions.

It has now been surprisingly discovered that the haze of oil compositions containing these ethylene-alpha-olefin copolymer viscosity index improvers can be reduced or substantially eliminated by the addition thereto or treatment thereof with a hydrocarbyl substituted succinic acid, a weak acid containing two hydrogen dissociating moieties both of which have pKs above 2.5 (e.g., succinic acid has a $pK_1$ of 4.16 and a $pK_2$ of 5.61).

SUMMARY OF THE INVENTION

It has been discovered that the haze in lubricating oil compositions containing certain specific types of ethylene-alpha-olefin copolymeric V.I. improvers can be reduced or substantially eliminated by treating said copolymer or its oil composition such as an oil concentrate composition, which typically comprises an oil such as lubricating oil and from 0.01 to 50, preferably 3 to 30 wt. % based upon said composition, of said oil soluble copolymer with a hydrocarbyl substituted succinic acid. The present invention has particular utility when the hazing substance is a metal salt of a weak acid, said weak acid having a pK of more than about 3.8, preferably a pK of 4.0 to about 8 and said hazing substance has a particle size of from about 0.01 microns to about 15 microns. It is preferred to treat the oil composition containing the hazing substance which is derived from the dissociable metal containing material, i.e. the weak acid, by introducing the oil-soluble hydrocarbyl substituted succinic acid within the range of from about 0.02 to about 0.5 weight percent, based on the weight of the oil composition.

The ethylene-alpha-olefin copolymers of the instant invention which are thus treated are disclosed in copending U.S. patent application Ser. No. 72,825, filed July 13, 1987, which is incorporated herein by reference. These copolymers are segmented copolymers of ethylene and at least one other alpha-olefin monomer; each copolymer is intramolecularly heterogeneous and intermolecularly homogeneous and at least one segment of the copolymer, constituting at least 10% of the copolymer's chain, is a crystallizable segment. For the purposes of this application, the term "crystallizable segment" is defined to be each segment of the copolymer chain having a number-average molecular weight of at least 700 wherein the ethylene content is at least 55 wt. %. The remaining segments of the copolymer chain are herein termed the "low crystallinity segments" and are characterized by an average ethylene content of not greater than about 53 wt. %. Furthermore, the molecular weight distribution (MWD) of copolymer is very narrow. It is well known that the breadth of the molecular weight distribution can be characterized by the ratios of various molecular weight averages. For example, an indication of a narrow MWD in accordance with the present invention is that the ratio of weight-to-number-average molecular weight ($\overline{M}_w/\overline{M}_n$ is less than 2. Alternatively, a ratio of the z-average molecular weight to the weight-average molecular weight ($\overline{M}_z/\overline{M}_w$) of less than 1.8 typifies a narrow MWD in accordance with the present invention. It is known that a portion of the property advantages of copolymers in accordance with the present invention are related to these ratios. Small weight fractions of material can disproportionately influence these ratios while not significantly altering the property advantages which depend on them. For instance, the presence of a small weight fraction (e.g. 2%) of low molecular weight copolymer can depress $\overline{M}_n$, and thereby raise $\overline{M}_w/\overline{M}_n$ above 2 while maintaining $\overline{M}_z/\overline{M}_w$ less than 1.8. Therefore, polymers, in accordance with the present invention, are characterized by having at least one of $\overline{M}_w/\overline{M}_n$ less than 2 and $\overline{M}_z/\overline{M}_w$ less than 1.8. The copolymer comprises chains within which the ratio of the monomers varies along the chain length. To obtain the intramolecular compositional heterogeneity and narrow MWD, the copolymers are preferably made in a tubular reactor.

DETAILED DESCRIPTION OF THE INVENTION

In accordance with the instant invention it has been discovered that the haze of an oil composition, such as a lubricating oil concentrate composition, containing a specific type of ethylene-alpha-olefin copolymer viscosity index improver can be reduced or substantially eliminated by treating said composition with a haze reducing effective amount of a hydrocarbyl substituted succinic acid.

In a preferred embodiment of the instant invention haze is reduced or substantially eliminated in a lubricating oil concentrate composition suitable for use in a lubricating oil composition comprising a lubricating oil and from about 0.01 to about 50 wt. % based on the weight of said concentrate composition of ethylene-alpha-olefin copolymer viscosity index improvers and a haze forming amount, e.g., less than about 1 wt. % based on the weight of said composition, of a hazing substance containing calcium stearate of particle diameter ranging from about 0.01 microns to about 15 microns by the step of treating said composition with a haze reducing effective amount of hydrocarbyl substituted succinic acid.

Ethylene and Alpha-Olefin Copolymer

The ethylene and alpha-olefin copolymers of the instant invention are described in U.S. patent application Ser. No. 72,825, filed July 13, 1987, which is incorporated herein by reference. These copolymers are copolymers of ethylene with at least one other alpha-olefin comprised of segmented copolymer chains with compositions which are intramolecularly heterogeneous and intermolecularly homogeneous.

For convenience, certain terms that are repeated throughout the present specification are defined below:

a. Inter-CD defines the compositional variation, in terms of ethylene content, among polymer chains. It is expressed as the minimum deviation (analogous to a standard deviation) in terms of weight percent ethylene, from the average ethylene composition for a given copolymer sample needed to include a given weight percent of the total copolymer sample, which is obtained by excluding equal weight fractions from both ends of the distribution. The deviation need not be symmetrical. When expressed as a single number, for example 15% Inter-CD, it shall mean the larger of the positive or negative deviations. For example, for a Gaussian compositional distribution, 95.5% of the polymer is within 20 wt. % ethylene of the mean if the standard deviation is 10%. The Inter-CD for 95.5 wt. % of the polymer is 20 wt. % ethylene for such a sample.

b. Intra-CD is the compositional variation, in terms of ethylene, within a copolymer chain. It is expressed as the minimum difference in weight (wt. %) ethylene that exists between two portions of a single copolymer chain, each portion comprising at least 5 weight % of the chain.

c. Molecular weight distribution (MWD) is a measure of the range of molecular weights within a given copolymer sample. It is characterized in terms of at least one of the ratios of weight-average to number-average molecular weight, $\overline{M}_w/\overline{M}_n$, and z-average to weight-average molecular weight, $\overline{M}_z/\overline{M}_w$, where:

$$\overline{M}_w = \frac{\Sigma N_i M_i^2}{\Sigma N_i M_i}$$

$$\overline{M}_n = \frac{\Sigma N_i M_i}{\Sigma N_i}, \text{ and}$$

$$\overline{M}_z = \frac{\Sigma N_i M_i^3}{\Sigma N_i M_i^2}$$

wherein $N_i$ is the number of molecules of molecular weight $M_i$.

d. Viscosity Index (V.I.) is the ability of a lubricating oil to accommodate increases in temperature with a minimum decrease in viscosity. The greater this ability, the higher the V.I.

The instant copolymers are segmented copolymers of ethylene and at least one other alpha-olefin monomer wherein the copolymer's chain contains at least one crystallizable segment of ethylene monomer units, as will be more completely described below, and at least one low crystallinity ethylene-alpha-olefin copolymer segment, where in the low crystallinity copolymer segment is characterized in the unoriented bulk state after at least 24 hours annealing by a degree of crystallinity of less than about 0.2% at 23° C., and wherein the copolymer's chain is intramolecularly heterogeneous and intermolecularly homogeneous, and has an MWD characterized by at least one of $\overline{M}_w/\overline{M}_n$ of less than 2 and $\overline{M}_z/\overline{M}_w$ of less than 1.8. The crystallizable segments comprise from about 10 to 90 wt. %, preferably from about 20 to 85 wt. %, of the total copolymer chain, and contain an average ethylene content which is at least about 57 wt. %, preferably at least about 62 wt. %, and more preferably at least about 63 wt. % and which is not greater than 95 wt. %, more preferably <85%, and most preferably <75 wt. % (e.g., from about 58 to 68 wt. %). The low crystallinity copolymer segments comprise from about 90 to 10 wt. %, preferably from about 80 to 15 wt. %, and more preferably from about 65 to 35 wt. %, of the total copolymer chain, and contain an average ethylene content of from about 20 to 53 wt. %, preferably from about 30 to 50 wt. %, and more preferably from about 35 to 50 wt. %. The copolymers comprise intramolecularly heterogeneous chain segments wherein at least two portions of an individual intramolecularly heterogeneous chain, each portion comprising at least 5 weight percent of the chain and having a molecular weight of at least 7000 contain at least 5 wt. % ethylene and differ in composition from one another by at least 5 weight percent ethylene, wherein the intermolecular compositional dispersity of the polymer is such that 95 wt. % of the polymer chains have a composition 15% or less different in ethylene from the average weight percent ethylene composition, and wherein the copolymer is characterized by at least one or a ratio of $\overline{M}_w/\overline{M}_n$ of less than 2 and a ratio of less than 1.8.

As described above, the copolymers will contain at least one crystallizable segment rich in methylene units (hereinafter called an "M" segment) and at least one low crystallinity ethylene-alpha-olefin copolymer segment (hereinafter called a "T" segment). The copolymers may be therefore illustrated by copolymers selected from the group consisting of copolymer chain structures having the following segment sequences:

$$M - T, \quad \text{(I)}$$
$$T^1 - (M - T^2)x, \text{ and} \quad \text{(II)}$$
$$T^1 - (M^1 - T^2)y - M^2 \quad \text{(III)}$$

wherein M and T are defined above, $M^1$ and $M^2$ can be the same or different and are each M segments, $T^1$ and $T^2$ can be the same or different and are each T segments, x is an integer of from 1 to 3 and y is an integer of 1 to 3.

In structure II (x=1), the copolymer's M segment is positioned between two T segments, and the M segment can be positioned substantially in the center of the polymer chain (that is, the $T^1$ and $T^2$ segments can be substantially the same molecular weight and the sum of the molecular weight of the $T^1$ and $T^2$ segments can be substantially equal to the molecular weight of the M segment), although this is not essential to the practice of this invention. Preferably, the copolymer will contain only one M segment per chain. Therefore, structures I and II (x=1) are preferred.

Preferably, the M segments and T segments of the copolymer are located along the copolymer chain so that only a limited number of the copolymer chains can associate before the steric problems associated with packing the low crystallinity T segments prevents further agglomeration Therefore, in a preferred embodiment, the M segment is located near the center of the copolymer chain and only one M segment is in the chain.

As will be shown below, a copolymer of the structure $$M^1-(T-M^2)_z \quad \text{(IV)}$$

(wherein $M^1$, $M^2$ and T are as defined above, and wherein z is an integer of at least 1) are undesirable as viscosity modifier polymers. It has been found that solutions of structure IV copolymers in oil tend to gel even when the M and T portions have exactly the same composition and molecular weight as structure II copolymers (with x=z=1). It is believed this poor viscosity modifier performance is due to the inability of a center T segment to sterically stabilize against association.

The M segments of the copolymers of this invention comprise ethylene and can also comprise at least one other alpha-olefin, e.g., containing 3 to 18 carbon atoms. The T segments comprise ethylene and at least one other alpha-olefin, e.g., alpha-olefins containing 3 to 18 carbon atoms. The M and T segments can also comprise other polymerizable monomers, e.g., non-conjugated dienes or cyclic mono-olefins.

Since the present invention is considered to be most preferred in the context of ethylene-propylene (EPM) copolymers it will be described in detail in the context of EPM.

The ethylene-alpha-olefin copolymer in accordance with the present invention is preferably made in a tubular reactor. When produced in a tubular reactor with monomer feed only at the tube inlet, it is known at the beginning of the tubular reactor, ethylene, due to its high reactivity , will be preferentially polymerized. The concentration of monomers in solution changes along the tube in favor of propylene as the ethylene is depleted. The result, with monomer feed only at the inlet, is copolymer chains which are higher in ethylene concentration in the chain segments grown near the reactor inlet (as defined at the point at which the polymerization reaction commences), and higher in propylene concentration in the chain segments formed near the reactor outlet. These copolymer chains are therefore tapered in composition. An illustrative copolymer chain of ethylene-propylene is schematically presented below with E representing ethylene constituents and P representing propylene constituents in the chain:

$$\text{Segment: } \overbrace{\text{E-E-E-E-P}}^{1}\text{-}\overbrace{\text{E-E-E-P-P}}^{2}\text{-}\overbrace{\text{E-E-P-P-P}}^{3}\text{-}\overbrace{\text{E-P-P-P-P}}^{4}$$

As can be seen from this illustrative schematic chain, the far left-hand segment (1) thereof represents that portion of the chain formed at the reactor inlet where the reaction mixture is proportionately richer in the more reactive constituent ethylene. This segment comprises four ethylene molecules and one propylene molecule. However, as subsequent segments are formed from left to right with the more reactive ethylene being depleted and the reaction mixture proportionately increasing in propylene concentration, the subsequent chain segments become more concentrated in propylene. The resulting chain is intramolecularly heterogeneous.

The property, of the copolymer discussed herein, related to intramolecular compositional dispersity (compositional variation within a chain) shall be referred to as Intra-CD, and that related to intermolecular compositional dispersity (compositional variation between chains) shall be referred to as Inter-CD.

For copolymers in accordance with the present invention, composition can vary between chains as well as along the length of the chain. An object of this invention is to minimize the amount of inter-chain variation. The Inter-CD can be characterized by the difference in composition between the copolymer fractions containing the highest and lowest quantity of ethylene. Techniques for measuring the breadth of the Inter-CD are known as illustrated in "Polymerization of ethylene and propylene to amorphous copolymers with catalysts of vanadium oxychloride and alkyl aluminum halides"; E. Junghanns, A. Gumboldt and G. Bier; Makromol. Chem., V. 58 (12/12/62): 18–42, wherein a p-xylene/-dimethylformamide solvent/non-solvent was used to fractionate copolymer into fractions of differing intermolecular composition. Other solvent/non-solvent systems can be used as hexane/2 propanol, as will be discussed in more detail below.

The Inter-CD of copolymer in accordance with the present invention is such that 95 wt. % of the copolymer chains have an ethylene composition that differs from the average weight percent ethylene composition by 15 wt. % or less. The preferred Inter-CD is about 13% or less, with the most preferred being about 10% or less. In comparison, Junghanns et al. found that their tubular reactor copolymer had an Inter-CD of greater than 15 wt. %.

Broadly, the Intra-CD of copolymer in accordance with the present invention is such that at least two portions of an individual intramolecularly heterogeneous chain, each portion comprising at least 5 weight percent of the chain, differ in composition from one another by at least 7 weight percent ethylene. Unless otherwise indicated, this property of Intra-CD as referred to herein is based upon at least two 5 weight percent portions of copolymer chain. The Intra-CD of copolymer in accordance with the present invention can be such that at least two portions of copolymer chain differ by at least 10 weight percent ethylene. Differences of at least 20 weight percent, as well as, of at least 40 weight percent ethylene are also considered to be in accordance with the present invention.

The experimental procedure for determining Intra-CD is as follows. First the Inter-CD is established as described below, then the polymer chain is broken into fragments along its contour and the Inter-CD of the fragments is determined. The difference in the two results is due to Intra-CD as can be seen in the illustrative example below.

Consider a heterogeneous sample polymer containing 30 monomer units. It consists of 3 molecules designated A, B, C.

| | |
|---|---|
| A | EEEEPEEEPEEEPPEEPPEPPPEPPPPPPP |
| B | EEEEEPEEEPEEEPPEEEPPPEPPPEEPPP |
| C | EEPEEEPEEEPEEEPEEEPPEEPPPEEPPP |

Molecule A is 36.8 wt. % ethylene, B is 46.6%, and C is 50% ethylene. The average ethylene content for the mixture is 44.3%. For this sample the Inter-CD is such that the highest ethylene polymer contains 5.7% more ethylene than the average while the lowest ethylene content polymer contains 7.5% less ethylene than the average. Or, in other words, 100 weight % of the polymer is within +5.7% and −7.5% ethylene about an average of 44.3%. Accordingly, the Inter-CD is 7.5% when the given weight % of the polymer is 100%.

If the chains are broken into fragments, there will be a new Inter-CD. For simplicity, consider first breaking only molecule A into fragments shown by the slashes as follows:

EEEEP/EEEPE/EEPPE/EPPEP/PPEPP/PPPPP

Portions of 72.7%, 72.7%, 50%, 30.8%, 14.3% and 0% ethylene are obtained. If molecules B and C are similarly broken and the weight fractions of similar composition are grouped a new Inter-CD is obtained.

In order to determine the fraction of a polymer which is intramolecularly heterogeneous in a mixture of polymers combined from several sources the mixture must be separated into fractions which show no further heterogenity upon subsequent fractionation. These fractions are subsequently fractured and fractionated to reveal which are heterogeneous.

The fragments into which the original polymer is broken should be large enough to avoid end effects and to give a reasonable opportunity for the normal statistical distribution of segments to form over a given monomer conversion range in the polymerization. Intervals of ca 5 weight % of the polymer are convenient. For example, at an average polymer molecular weight of about 105, fragments of ca 5000 molecular weight are appropriate. A detailed mathematical analysis of plug flow or batch polymerization indicates that the rate of change of composition along the polymer chain contour will be most severe at high ethylene conversion near the end of the polymerization. The shortest fragments are needed here to show the low ethylene content sections.

The best available technique for determination of compositional dispersity for non-polar polymers is solvent/non-solvent fractionation which is based on the thermodynamics of phase separation. This technique is described in "Polymer Fractionation", M. Cantow editor, Academic 1967, p. 341 and in H. Inagaki, T. Tanaku, "*Developments in Polymer Characterization*", 3, 1, (1982). These are incorporated herein by reference.

For non-crystalline copolymers of ethylene and propylene, molecular weight governs insolubility more than does composition in a solvent/non-solvent solution. High molecular weight polymer is less soluble in a given solvent mix. Also, there is a systematic correlation of molecular weight with ethylene content for the polymers described herein. Since ethylene polymerizes much more rapidly than propylene, high ethylene polymer also tends to be high in molecular weight. Additionally, chains rich in ethylene tend to be less soluble in hydrocarbon/polar non-solvent mixtures than propylene-rich chains. Furthermore, for crystalline segments, solubility is significantly reduced. Thus, the high molecular weight, high ethylene chains are easily separated on the basis of thermodynamics.

A fractionation procedure is as follows: Unfragmented polymer is dissolved in n-hexane at 23° C. to form ca a 1% solution (1 g. polymer/100 cc hexane). Isopropyl alcohol is titrated into the solution until turbidity appears at which time the precipitate is allowed to settle. The supernatant liquid is removed and the precipitate is dried by pressing between Mylar ® polyethylene terphthalate) film at 150° C. Ethylene content is determined by ASTM method D-3900. Titration is resumed and subsequent fractions are recovered and analyzed until 100% of the polymer is collected. The titrations are ideally controlled to produce fractions of 5–10% by weight of the original polymer, especially at the extremes of composition.

To demonstrate the breadth of the distribution, the data are plotted as % ethylene versus the cumulative weight of polymer as defined by the sum of half the weight of the fraction of that composition plus the total weight of the previously collected fractions.

Another portion of the original polymer is broken into fragments. A suitable method for doing this is by thermal degradation according to the following procedure:

In a sealed container in a nitrogen-purged oven, a 2 mm thick layer of the polymer is heated for 60 minutes at 330° C. (The time or temperature can be empirically adjusted based on the ethylene content and molecular weight of the polymer.) This should be adequate to reduce a 105 molecular weight polymer to fragments of ca 5000 molecular weight. Such degradation does not substantially change the average ethylene content of the polymer, although propylene tends to be lost on scission in preference to ethylene. This polymer is fractionated by the same procedure as the high molecular weight precursor. Ethylene content is measured , as well as molecular weight on selected fractions.

The procedure to characterize intramolecular heterogeneity is laborious and even when performed at an absolute optimum, does not show how the segments of the chain are connected. In fact it is not possible, with current technology, to determine the polymer structure without recourse to the synthesis conditions. With knowledge of the synthesis conditions, the structure can be defined as follows.

Ethylene, propylene or high alpha-olefin polymerizations with transition metal catalysts can be described by the terminal copolymerization model, to an approximation adequate for the present purpose. (G. Ver Strate, *Encyclopedia of Polymer Science and Engineering,* vol. 6, 522 (1986)). In this model, the relative reactivity of the two monomers is specified by two reactivity ratios defined as follows:

$$R_1 = \frac{\text{(rate constant for ethylene adding to ethylene)}}{\text{(rate constant for propylene adding to ethylene)}}$$

$$R_2 = \frac{\text{(rate constant for propylene adding to propylene)}}{\text{(rate constant for ethylene adding to propylene)}}$$

Given these two constants, at a given temperature, the ratio of the molar amount of ethylene, E, to the molar amount of propylene, P, entering the chain from a solution containing ethylene and propylene at molar concentrations [E] and [P] respectively is $$\frac{E}{P} = \frac{[E]}{[P]} \cdot \frac{(R_1[E] + [P])}{([E] + R_2[P])} \quad (1)$$

The relation of E and P to the weight % ethylene in the polymer is as follows $$\text{weight \% ethylene} = \frac{E}{E + 1.5\,P} \cdot 100$$

The values of $R_1$ and $R_2$ are dependent on the particular comonomer and catalyst employed to prepare the polymer, the polymerization temperature and, to some extent, the solvent.

For all transition metal catalysts specified herein, R1 is significantly larger than R2. Thus, as can be seen from equation (1), ethylene will be consumed more rapidly than propylene for a given fraction of the monomer in the reacting medium. Thus, the ratio of [E]/[P] will decrease as the monomers are consumed. Only if $R_1 = R_2$ will the composition in the polymer equal that in the reacting medium.

If the amount of monomer that has reacted at a given time in a batch reactor or at a given point in a tubular reactor can be determined, it is possible through equation (1), to determine the instantaneous composition being formed at a given point along the polymer chain. Demonstration of narrow MWD and increasing MW along the tube proves the compositional distribution is intramolecular. The amount of polymer formed can be determined in either of two ways. Samples of the polymerizing solution may be collected, with appropriate quenching to terminate the reaction at various points along the reactor, and the amount of polymer formed evaluated. Alternatively, if the polymerization is run adiabatically and the heat of polymerization is known, the amount of monomer converted may be calculated from the reactor temperature profile.

Finally, if the average composition of the polymer is measured at a series of locations along the tube, or at various times in the batch polymerization case, it is possible to calculate the instantaneous composition of the polymer being made. This technique does not require knowledge of $R_1$ and $R_2$ or the heat of polymerization, but it does require access to the polymer synthesis step.

All of these methods have been employed with consistent results.

For the purpose of this patent, $R_1$ and $R_2$ thus simply serve to characterize the polymer composition in terms of the polymerization conditions. By defining $R_1$ and $R_2$, we are able to specify the intramolecular compositional distribution. In the examples shown below where $VCl_4$ and ethylaluminum sesquichloride are employed in hexane as solvent, $R_1 = 1.8\ \exp(+500/RT_k)$ and $R_2 = 3.2\ \exp(-1500/RT_k)$. Where "R" is the gas constant (1.98 col/deg-mole) and "$T_k$" is degrees Kelvin. For reference, at 20° C. $R_1 = 9.7$, $R_2 = 0.02$.

The $R_1$ and $R_2$ given above predict the correct final average polymer composition. If the $R_1$ and $R_2$ and expression (2) are someday proven to be inaccurate the polymer intramolecular compositional distribution will remain as defined herein in terms of the polymerization conditions but may have to be modified on the absolute composition scales. There is little likelihood that they are in error by more than a few percent, however.

Ethylene content is measured by ASTM-D3900 for ethylene-propylene copolymers between 35 and 85 wt. % ethylene. Above 85% ASTM-D2238 can be used to obtain methyl group concentrations which are related to percent ethylene in an unambiguous manner for ethylene-propylene copolymers. When comonomers other than propylene are employed no ASTM tests covering a wide range of ethylene contents are available; however, proton and carbon-13 nuclear magnetic reasonance spectroscopy can be employed to determine the composition of such polymers. These are absolute techniques requiring no calibration when operated such that all nucleii of a given element contribute equally to the spectra. For ranges not covered by the ASTM tests for ethylene-propylene copolymers, these nuclear magnetic resonance methods can also be used.

Molecular weight and molecular weight distribution are measured using a Waters 150C gel permeation chromatography equipped with a Chromatix KMX-6 (LDC-Milton Roy, Riviera Beach, Fla.) on-line light scattering photometer. The system is used at 135° C. with 1,2,4 trichlorobenzene as mobile phase. Showdex (Showa- Denko America, Inc.) polystyrene gel columns 802, 803, 804 and 805 are used. This technique is discussed in "Liquid Chromatography of Polymers and Related Materials III", J. Cazes editor. Marcel Dekker, 1981, p. 207 (incorporated herein by reference). No corrections for column spreading are employed; however, data on generally accepted standards, e.g., National Bureau of Standards Polyethene 1484 and anionically produced hydrogenated polyisoprenes (an alternating ethylene-propylene copolymer) demonstrate that such corrections on $\overline{M}_w/\overline{M}_n$ or $\overline{M}_z/\overline{M}_w$ are less than 0.05 unit. $\overline{M}_w/\overline{M}_n$ is calculated from an elution time-molecular weight relationship whereas $\overline{M}_z/\overline{M}_w$ is evaluated using the light scattering photometer. The numerical analyses can be performed using the commercially available computer software GPC2, MOLWT2 available from LDC/Milton Roy-Riviera Beach, Fla.

As already noted, copolymers in accordance with the present invention are comprised of ethylene and at least one other alpha-olefin. It is believed that such alpha-olefins could include those containing 3 to 18 carbon atoms, e.g., propylene, butene-1, pentene-1, etc. Alpha-olefins of 3 to 6 carbons are preferred due to economic considerations. The most preferred copolymers in accordance with the present invention are those comprised of ethylene and propylene.

As is well known to those skilled in the art, copolymers of ethylene and higher alpha-olefins such as propylene often include other polymerizable monomers. Typical of these other monomers may be non-conjugated dienes such as the following non-limiting examples:

a. straight chain acyclic dienes such as: 1,4-hexadiene; 1,6-octadiene;
b. branched chain acyclic dienes such as: 5-methyl-1, 4-hexadiene; 3, 7-dimethyl-1,6-octadiene; 3, 7-dimethyl-1,7-octadiene and the mixed isomers of dihydro-myrcene and dihydroocinene;
c. single ring alicyclic dienes such as: 1, 4-cyclohexadiene; 1,5-cyclooctadiene; and 1,5-cyclododecadiene;
d. multi-ring alicyclic fused and bridged ring dienes such as: tetrahydroindene; methyltetrahydroindene; dicyclopentadiene; bicyclo-(2,2,1)-hepta-2, 5-diene; alkenyl, alkylidene, cycloalkenyl and cycloalkylidene norbornenes such as 5-methylene-2-norbornene (MNB), 5-ethylidene-2-norbornene (ENB), 5-propylene-2-norbornene, 5-isopropylidene-2-norbornene, 5-(4-cyclopentenyl)-2-norbornene; 5-cyclohexylidene-2-norbornene.

Of the non-conjugated dienes typically used to prepare these copolymers, dienes containing at least one of the double bonds in a strained ring are preferred. The most preferred diene is 5-ethylidene-2-norbornene (ENB). The amount of diene (wt. basis) in the copolymer could be from about 0% to 20% with 0% to 15% being preferred. The most preferred range is 0% to 10%.

As already noted, the most preferred copolymer in accordance with the present invention is ethylene-propylene. The average ethylene content of the copolymer could be as low as about 20% on a weight basis. The preferred minimum is about 25%. A more preferred minimum is about 30%. The maximum ethylene content could be about 90% on a weight basis. The preferred maximum is about 85%, with the most preferred being about 80%. Preferably, the copolymers of this invention intended for use as viscosity modifier-dispersant contain from about 35 to 75 wt. % ethylene, and more preferably from about 50 to 70 wt. % ethylene.

The molecular weight of copolymer made in accordance with the present invention can vary over a wide range. It is believed that the weight-average molecular weight could be as low as about 2,000. The preferred minimum is about 10,000. The most preferred minimum is about 20,000. It is believed that the maximum weight-average molecular weight could be as high as about 12,000,000. The preferred maximum is about 1,000,000. The most preferred maximum is about 750,000. An especially preferred range of weight-average molecular weight for copolymers intended for use as V.M. polymer is from 50,000 to 500,000.

The copolymers of this invention will also be generally characterized by a Mooney viscosity (i.e., ML(1,+4,) 125° C.) of from about 1 to 100, preferably from about 10 to 70, and more preferably from about 15 to 65, and by a thickening efficiency ("TE") of from about 0.4 to 5.0, preferably from about 1.0 to 4.0, most preferably from about 1.4 to 3.8.

Another feature of copolymer of the present invention is that the molecular weight distribution (MWD) is very narrow, as characterized by at least one of a ratio of $\overline{M}_w/\overline{M}_n$ of less than 2 and a ratio of $\overline{M}_z/\overline{M}_w$ less than 1.8. As relates to EPM and EPDM, a typical advantage of such copolymers having narrow MWD is resistance to shear degradation. Particularly for oil additive applications, the preferred copolymers have $\overline{M}_w/\overline{M}_n$ less than about 1.5, with less than about 1.25 being most preferred. The preferred $\overline{M}_z/\overline{M}_w$ is less than about 1.5, with less than about 1.2 being most preferred.

The copolymers of the instant invention may be produced by polymerization of a reaction mixture comprised of catalyst, ethylene and at least one additional alpha-olefin monomer, wherein the amounts of monomer, and preferably ethylene, is varied during the course of the polymerization in a controlled manner as will be hereinafter described. Solution polymerizations are preferred.

Any known solvent for the reaction mixture that is effective for the purpose can be used in conducting solution polymerizations in accordance with the present invention. For example, suitable solvents would be hydrocarbon solvents such as aliphatic, cycloaliphatic and aromatic hydrocarbon solvents, or halogenated versions of such solvents. The preferred solvents are $C_{12}$ or lower, straight chain or branched chain, saturated hydrocarbons, $C_5$ to $C_9$ saturated alicyclic or aromatic hydrocarbons or $C_2$ to $C_6$ halogenated hydrocarbons. Most preferred are $C_{12}$ or lower, straight chain or branched chain hydrocarbons, particularly hexane. Non-limiting illustrative examples of solvents are butane, pentane, hexane, heptane, cyclopentane, cyclohexane, cycloheptane, methyl cyclopentane, methyl cyclohexane, isooctane, benzene, toluene, xylene, chloroform, chlorobenzenes, tetrachloroethylene, dichloroethane and trichloroethane.

These polymerizations are carried out in a mix-free reactor system, which is one in which substantially no mixing occurs between portions of the reaction mixture that contain polymer chains initiated at different times. Suitable reactors are a continuous flow tubular or a stirred batch reactor. A tubular reactor is well known and is designed to minimize mixing of the reactants in the direction of flow. As a result, reactant concentration will vary along the reactor length. In contrast, the reaction mixture in a continuous flow stirred tank reactor (CFSTR) is blended with the incoming feed to produce a solution of essentially uniform composition everywhere in the reactor. Consequently, the growing chains in a portion of the reaction mixture will have a variety of ages and thus a single CFSTR is not suitable for the process of this invention. However, it is well known that 3 or more stirred tanks in series with all of the catalyst fed to the first reactor can approximate the performance of a tubular reactor. Accordingly, such tanks in series are considered to be in accordance with the present invention.

A batch reactor is a suitable vessel, preferably equipped with adequate agitation, to which the catalyst, solvent, and monomer are added at the start of the polymerization. The charge of reactants is then left to polymerize for a time long enough to produce the desired product or chain segment. For economic reasons, a tubular reactor is preferred to a batch reactor for carrying out the processes of this invention.

In addition to the importance of the reactor system to make copolymers in accordance with the present invention, the polymerization should be conducted such that:

(a) the catalyst system produces essentially one active catalyst species,
(b) the reaction mixture is essentially free of chain transfer agents, and
(c) the polymer chains are essentially all initiated simultaneously, which is at the same time for a batch reactor or at the same point along the length of the tube for a tubular reactor.

To prepare copolymer structures II and III above (and, optionally, to prepare copolymer structure I above), additional solvent and reactants (e.g., at least one of the ethylene, alpha-olefin and diene) will be added either along the length of a tubular reactor or during the course of polymerization in a batch reactor, or to selected stages of stirred reactors in series in a controlled manner (as will be hereinafter described) to form the copolymers of this invention. However, it is necessary to add essentially all of the catalyst at the inlet of the tube or at the onset of batch reactor operation to meet the requirement that essentially all polymer chains are initiated simultaneously.

Accordingly, polymerization in accordance with the present invention are carried out:

(a) in at least one mix-free reactor,
(b) using a catalyst system that produces essentially one active catalyst species,
(c) using at least one reaction mixture which is essentially transfer agent-free, and
(d) in such a manner and under conditions sufficient to initiate propagation of essentially all polymer chains simultaneously.

Since the tubular reactor is the preferred reactor system for carrying out polymerizations in accordance with the present invention, the following illustrative descriptions are drawn to that system, but will apply to other reactor systems as will readily occur to the artisan having the benefit of the present disclosure.

In practicing polymerization processes in accordance with the present invention, use is preferably made of at least one tubular reactor. Thus, in its simplest form, such a process would make use of but a single, reactor. However, as would readily occur to the artisan having the benefit of the present disclosure, a series of reactors could be used with multiple monomer feed to vary intramolecular composition as described below.

The composition of the catalyst used to produce alpha-olefin copolymers has a profound effect on copolymer product properties such as compositional dispersity and MWD. The catalyst utilized in practicing processes in accordance with the present invention should be such as to yield essentially one active catalyst species in the reaction mixture. More specifically, it should yield one primary active catalyst species which provides for substantially all of the polymerization reaction. Additional active catalyst species could provide as much as 35% (weight) of the total copolymer. Preferably, they should account for about 10% or less of the copolymer. Thus, the essentially one active species should provide for at least 65% of the total copolymer produced, preferably for at least 90% thereof. The extent to which a catalyst species contributes to the polymerization can be readily determined using the below-described techniques for characterizing catalyst according to the number of active catalyst species.

Techniques for characterizing catalyst according to the number of active catalyst species are within the skill of the art, as evidenced by an article entitled "Ethylene-Propylene Copolymers. Reactivity Ratios, Evaluation and Significance", C. Cozewith and G. Ver Strate, *Macromolecules*, 4, 482 (1971), which is incorporated herein by reference.

It is disclosed by the authors that copolymers made in a continuous flow stirred reactor should have an MWD characterized by $\overline{M}_w/\overline{M}_n=2$ and a narrow Inter-CD when one active catalyst species is present. By a combination of fractionation and gel permeation chromatography (GPC) it is shown that for single active species catalysts the compositions of the fractions vary no more than ±3% about the average and the MWD (weight- to number-average ratio) for these samples approaches 2. It is this latter characteristic ($\overline{M}_w/\overline{M}_n$ of about 2) that is deemed the more important in identifying a single active catalyst species. On the other hand, other catalysts gave copolymer with an Inter-CD greater than ±10% about the average and multi-modal MWD often with $\overline{M}_w/\overline{M}_n$ greater than 10. These other catalysts are deemed to have more than one active species.

Catalyst systems to be used in carrying out processes in accordance with the present invention may be Ziegler catalysts, which may typically include:

(a) a compound of a transition metal, i.e., a metal of Groups I-B, III-B, IVB, VB, VIB, VIIB and VIII of the Periodic Table, and (b) an organometal compound of a metal of Groups I-A, II-A, II-B and III-A of the Periodic Table.

The preferred catalyst system in practicing processes in accordance with the present invention comprises hydrocarbon-soluble vanadium compound in which the vanadium valence is 3 to 5 and an organo-aluminum compound, with the proviso that the catalyst yields essentially one active catalyst species as described above. At least one of the vanadium compound/organo-aluminum pair selected must also contain a valence-bonded halogen. In terms of formulas, vanadium compounds useful in practicing processes in accordance with the present invention could be:

$$\overset{O}{\overset{\|}{VCl_x(OR)_{3-x}}} \quad (1)$$

where x=0–3 and R=a hydrocarbon radical;

$VCl_4$;

$VO(AcAc)_2$, where AcAc=acetyl acetonate which may or may not be alkyl-substituted (e.g.$C_1$ to $C_6$ alkyl);

$V(AcAc)_3$;

V(dicarbonyl moiety)3;

$VOCl_x(AcAc)_{3-x}$;

where x=1 or 2;

V(dicarbonyl moiety)$_3$Cl; and $VCl_3$.nB, where n=2-3, B=Lewis base capable of making hydrocarbon-soluble complexes with $VCl_3$, such as tetrahydrofuran, 2-methyl-tetrahydrofuran and dimethyl pyridine, and the dicarbonyl moiety is derived from a dicarbonyl compound of the formula:

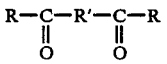

In formula (1) above, each R (which can be the same or different) preferably represents a $C_1$ to $C_{10}$ aliphatic, alicyclic or aromatic hydrocarbon radical such as ethyl (Et), phenyl, isopropyl, butyl, propyl, n-butyl, i-butyl, t-butyl, hexyl, cyclohexyl, octyl, naphthyl, etc. R, preferably represents an alkylene divalent radical of 1 to 6 carbons (e.g. , $—CH_2—$, $—C_2H_4—$, etc.). Nonlimiting illustrative examples of formula (1) compounds are vanadyl trihalides, alkoxy halides and alkoxides such as $VOCl_3$, $VOCl_2$ (OBu) where Bu=butyl, and $VO(OC_2H_5)_3$. The most preferred vanadium compounds are $VCl_4$, $VOCl_3$, and $VOCl_2(OR)$.

As already noted, the co-catalyst is preferably organo-aluminum compound. In terms of chemical formulas, these compounds could be as follows:

| | |
|---|---|
| $AlR_3$, | $Al(OR)R_2$, |
| $AlR_2Cl$, | $R_2Al—AlR_2$, |
| AlR,RCl, | $AlR_2I$, |
| $Al_2R_3Cl_3$, | and |
| $AlRCl_2$, | |

where R, $R_2$ and $R_3$, represent hydrocarbon radicals, and are the same or different, as described above with respect to the vanadium compound formula. The most preferred organo-aluminum compound is an aluminum alkyl sesquichloride such as $Al_2Et_3Cl_3$ or $Al_2(iBu)_3Cl_3$.

In terms of performance, a catalyst system comprised of $VCl_4$ and $Al_2R_3Cl_3$, preferably where R is ethyl, has been shown to be particularly effective. For best catalyst performance, the molar amounts of catalyst components added to the reaction mixture should provide a molar ratio of aluminum/vanadium (Al/V) of at least about 2. The preferred minimum Al/V is about 4. The maximum Al/V is based primarily on the considerations of catalyst expense and the desire to minimize the amount of chain transfer that may be caused by the organo-aluminum compound (as explained in detail below). Since, as is known certain organo-aluminum compounds act as chain transfer agents, if too much is present in the reaction mixture the $\overline{M}_w/\overline{M}_n$ of the copolymer may rise above 2. Based on these considerations, the maximum Al/V could be about 25, however, a maximum of about 17 is more preferred. The most preferred maximum is about 15.

With reference again to processes for making copolymer in accordance with the present invention, it is well known that certain combinations of vanadium and aluminum compounds that can comprise the catalyst system can cause branching and gelation during the polymerization for polymers containing high levels of diene. To prevent this from happening Lewis bases such as ammonia, tetrahydrofuran, pyridine, tributylamine, tetrahydrothiophene, etc., can be added to the polymerization system using techniques well known to those skilled in the art.

Chain transfer agents for the Ziegler-catalyzed polymerization of alpha-olefins are well known and are illustrated, by way of example, by hydrogen or diethyl zinc for the production of EPM and EPDM. Such agents are very commonly used to control the molecular weight of EPM and EPDM produced in continuous flow stirred tank reactors. For the essentially single active species Ziegler catalyst systems used in accordance with the present invention, addition of chain transfer agents to a CFSTR reduces the polymer molecular weight but does not affect the molecular weight distribution. On the other hand, chain transfer reactions during tubular reactor polymerization in accordance with the present invention broaden polymer molecular weight distribution and Inter-CD. Thus the presence of chain transfer agents in the reaction mixture should be minimized or omitted altogether. Although difficult to generalize for all possible reactions, the amount of chain transfer agent used should be limited to those amounts that provide copolymer product in accordance with the desired limits as regards MWD and compositional dispersity. It is believed that the maximum amount of chain transfer agent present in the reaction mixture could be as high as about 0.2 mol/mol of transition metal, e.g., vanadium, again provided that the resulting copolymer product is in accordance with the desired limits as regards MWD and compositional dispersity. Even in the absence of added chain transfer agent, chain transfer reactions can occur because propylene and the organo-aluminum cocatalyst can also act as chain transfer agents. In general, among the organo-aluminum compounds that in combination with the vanadium compound yield just one active species, the organo-aluminum compound that gives the highest copolymer molecular weight at acceptable catalyst activity should be chosen. Furthermore, if the Al/V ratio has an effect on the molecular weight of copolymer product, that Al/V should be used which gives the highest molecular weight also at acceptable catalyst activity. Chain transfer with propylene can best be limited by avoiding excessively elevated temperature during the polymerization as described below.

Molecular weight distribution and Inter-CD are also broadened by catalyst deactivation during the course of the polymerization which leads to termination of growing chains. It is well known that the vanadium-based Ziegler catalysts used in accordance with the present invention are subject to such deactivation reactions which depend to an extent upon the composition of the catalyst. Although the relationship between active catalyst lifetime and catalyst system composition is not known at present, for any given catalyst, deactivation can be reduced by using the shortest residence time and lowest temperature in the reactor that will produce the desired monomer conversions.

Polymerizations in accordance with the present invention should be conducted in such a manner and under conditions sufficient to initiate propagation of essentially all copolymer chains simultaneously. This can be accomplished by utilizing the process steps and conditions described below.

The catalyst components are preferably premixed, that is, reacted to form active catalyst outside of the reactor, to ensure rapid chain initiation. Aging of the premixed catalyst system, that is, the time spent by the catalyst components (e.g., vanadium compound and organo-aluminum) in each other's presence outside of the reactor, should preferably be kept within limits. If not aged for a sufficient period of time, the components will not have reacted with each other sufficiently to yield an adequate quantity of active catalyst species, with the result of nonsimultaneous chain initiation. Also, it is known that the activity of the catalyst species will decrease with time so that the aging must be kept below a maximum limit. It is believed that the minimum aging period, depending on such factors as concentration of catalyst components, temperature and mixing equipment, could be as low as about 0.1 second. The preferred minimum aging period is about 0.5 second, while the most preferred minimum aging period is about 1 second. While the maximum aging period could be higher, for the preferred vanadium/organo-aluminum catalyst system the preferred maximum is about 200 seconds. A more preferred maximum is about 100 seconds. The most preferred maximum aging period is about 50 seconds. The premixing could be performed at low temperature such as 40° C. or below. It is preferred that the premixing be performed at 25° C. or below, with 20° C. or below being most preferred.

Preferably, the catalyst components are premixed in the presence of the selected polymerization diluent or solvent under rapid mixing conditions, e.g., at impingement Reynolds Numbers (NRE) of at least 10,000, more preferably at least 50,000, and most preferably at least 100,000. Impingement Reynolds number is defined as $$N_{RE} = \frac{DN\rho}{\mu}$$

where N is fluid flow velocity (cm/sec), D is inside tube diameter (cm), $\rho$ is fluid density (g./cm$^3$) and $\mu$ is fluid viscosity (poise).

The temperature of the reaction mixture should also be kept within certain limits. The temperature at the reactor inlets should be high enough to provide complete, rapid chain initiation at the start of the polymerization reaction. The length of time the reaction mixture spends at high temperature must be short enough to minimize the amount of undesirable chain transfer and catalyst deactivation reactions.

Temperature control of the reaction mixture is complicated somewhat by the fact that the polymerization reaction generates large quantities of heat. This problem is, preferably, taken care of by using prechilled feed to the reactor to absorb the heat of polymerization. With this technique, the reactor is operated adiabatically and the temperature is allowed to increase during the course of polymerization. As an alternative to feed prechill, heat can be removed from the reaction mixture, for example, by a heat exchanger surrounding at least a portion of the reactor or by well-known autorefrigeration techniques in the case of batch reactors or multiple stirred reactors in series.

If adiabatic reactor operation is used, the inlet temperature of the reactor feed could be about from −50° C. to 150° C. It is believed that the outlet temperature of the reaction mixture could be as high as about 200° C. The preferred maximum outlet temperature is about 70° C. The most preferred maximum is about 60° C. In the absence of reactor cooling, such as by a cooling jacket, to remove the heat of polymerization, it has been determined (for a mid-range ethylene content EP copolymer and a solvent with heat capacity similar to hexane) that the temperature of the reaction mixture will increase from reactor inlet to outlet by about 13° C. per weight percent of copolymer in the reaction mixture (weight of copolymer per weight of solvent).

Having the benefit of the above disclosure, it would be well within the skill of the art to determine the operating temperature conditions for making copolymer in accordance with the present invention. For example, assume an adiabatic reactor and an outlet temperature of 35° C. are desired for a reaction mixture containing 5% copolymer. The reaction mixture will increase in temperature by about 13° C. for each weight percent copolymer or 5 wt %×13° C./Wt. %=65° C. To maintain an outlet temperature of 35° C., it will thus require a feed that has been prechilled to 35° C.-65° C.=−30° C. In the instance that external cooling is used to absorb the heat of polymerization, the feed inlet temperature could be higher with the other temperature constraints described above otherwise being applicable.

Because of heat removal and reactor temperature limitations, the preferred maximum copolymer concentration at the reactor outlet is 25 wt./100 wt. diluent. The most preferred maximum concentration is 15 wt/100 wt. There is no lower limit to concentration due to reactor operability, but for economic reasons it is preferred to have a copolymer concentration of at least 2 wt/100 wt. Most preferred is a concentration of at least 3 wt/100 wt.

The rate of flow of the reaction mixture through the reactor should be high enough to provide good mixing of the reactants in the radial direction and minimize mixing in the axial direction. Good radial mixing is beneficial not only to both the Intra- and Inter-CD of the copolymer chains but also to minimize radial temperature gradients due to the heat generated by the polymerization reaction. Radial temperature gradients in the case of multiple segment polymers will tend to broaden the molecular weight distribution of the copolymer since the polymerization rate is faster in the high temperature regions resulting from poor heat dissipation. The artisan will recognize that achievement of these objectives is difficult in the case of highly viscous solutions. This problem can be overcome to some extent through the use of radial mixing devices such as static mixers (e.g., those produced by the Kenics Corporation).

It is believed that residence time of the reaction mixture in the mix-free reactor can vary over a wide range. It is believed that the minimum could be as low as about 0.2 second. A preferred minimum is about 0.5 second. The most preferred minimum is about 1 second. It is believed that the maximum could be as high as about 3600 seconds. A preferred maximum is about 40 seconds. The most preferred maximum is about 20 seconds.

Preferably, the fluid flow of the polymerization reaction mass through the tubular reactor will be under turbulent conditions, e.g., at a flow Reynolds Number (NR) of at least 10,000, more preferably at least 50,000, and most preferably at least 100,000 (e.g., 150,000 to 250,000), to provide the desired radial mixing of the fluid in the reactor. Flow Reynolds Number is defined as $$NR = \frac{D'N'\rho}{\mu}$$

wherein N, is fluid flow velocity (cm/sec), D', is inside tube diameter of the reactor (cm), $\rho$ is fluid density ($g/cm^3$) and $\mu$ is fluid viscosity (poise).

If desired, catalyst activators for the selected vanadium catalysts can be used as long as they do not cause the criteria for a mix-free reactor to be violated, typically in amounts up to 20 mol %, generally up to 5 mol %, based on the vanadium catalyst, e.g., butyl perchlorocrotonate, benzoyl chloride, and other activators disclosed in Ser. Nos. 504,945 and 50,946, filed May 15, 1987, the disclosures of which are hereby incorporated by reference in their entirety. Other useful catalyst activators include esters of halogenated organic acids, particularly alkyl trichloroacetates, alkyl tribromoacetates, esters of ethylene glycol monoalkyl (particularly monoethyl) ethers with trichloroacetic acid and alkyl perchlorocrotonates, and acyl halides. Specific examples of these compounds include benzoyl chloride, methyl trichloroacetate, ethyl trichloroacetate, methyl tribromoacetate, ethyl tribromoacetate, ethylene glycol monoethyl ether trichloroacetate, ethylene glycol monoethyl ether tribromoacetate, butyl perchlorocrotonate and methyl perchlorocrotonate.

By practicing processes in accordance with the present invention, alpha-olefin copolymers having very narrow MWD can be made by direct polymerization Although narrow MWD copolymers can be made using other known techniques, such as by fractionation or mechanical degradation, these techniques are considered to be impractical to the extent of being unsuitable for commercial-scale operation. As regards EPM and EPDM made in accordance with the present invention, the products have good shear stability and (with specific intramolecular CD) excellent low temperature properties which make them especiallly suitable for lube oil applications.

It is preferred that the Intra-CD of the copolymer is such that at least two portions of an individual intramolecularly heterogeneous chain, each portion comprising at least 5 weight percent of said chain, differ in composition from one another by at least 5 weight percent ethylene. The Intra-CD can be such that at least two portions of copolymer chain differ by at least 10 weight percent ethylene. Differences of at least 20 weight percent, as well as, 40 weight percent ethylene are also considered to be in accordance with the present invention.

It is also preferred that the Inter-CD of the copolymer is such that 95 wt. % of the copolymer chains have an ethylene composition that differs from the copolymer average weight percent ethylene composition by 15 wt. % or less. The preferred Inter-CD is about 13% or less, with the most preferred being about 10% or less.

OIL SOLUBLE HYDROCARBYL SUBSTITUTED SUCCINIC ACID

In accordance with the practice of this invention, the hazy oil concentrate compositions or oil compositions are treated with the oil-soluble hydrocarbyl substituted succinic acid. The hydrocarbyl moiety of the succinic acid may be alkenyl or alkyl. The hydrocarbyl moiety contains at least a sufficiently long carbon chain to render the hydrocarbyl substituted succinic acid oil soluble. Thus, the hydrocarbyl moiety contains at least 10 carbon atoms, preferably at least about 12 carbon atoms, and more preferably at least 12 carbon atoms. Generally, the hydrocarbyl moiety contains less than about 100 carbon atoms, preferably less than about 30 carbon atoms, and more preferably less than about 20 carbon atoms. In a preferred embodiment, the hydrocarbyl substituted succinic acid is a $C_{10}$ to about $C_{20}$, preferably a $C_{12}$ to about $C_{18}$, more preferably a $C_{12}$ to about $C_{16}$, and most preferably a $C_{12}$ hydrocarbyl, preferably alkyl substituted succinic acid. The preferred hydrocarbyl substituted succinic acids may be represented by the general formula

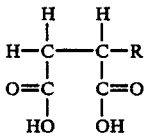

wherein R is a $C_{10}$–$C_{100}$, preferably $C_{12}$–$C_{20}$, more preferably a $C_{12}$–$C_{18}$, and most preferably a $C_{12}$–$C_{16}$ hydrocarbyl, preferably alkyl radical. The alkyl radicals represented by R may be branched or straight chain. However, straight chain alkyl radicals are preferred.

Some illustrative non-limiting examples of the hydrocarbyl substituted succinic acids include decyl succinic acid, dodecyl succinic acid, tridecyl succinic acid, tetradecyl succinic acid, octadecyl succinic acid, and polyisobutenyl succinic acid.

The hydrocarbyl substituted succinic acid haze treating agents of the present invention contain two hydrogen dissociating moieties which have pKs above about 3, preferably above about 4, i.e., a $pK_1$ and a $pK_2$ of at least 3, preferably at least 4. For the purposes of the instant invention the pK can be defined as the negative logarithm to the base 10 of the equilibrium constant for the dissociation of the acid.

HAZE TREATING CONDITIONS

The oil composition such as a lubricating oil concentrate composition containing the ethylene-alpha-olefin copolymer viscosity index improver normally contains at least a viscosity index improving amount, e.g., from about 0.01 to about 50, preferably from about 1 to about 50, and more preferably from about 2 to about 30, wt. %, based upon the total weight of the oil composition, of said copolymer. The oil compositions such as oil concentrate compositions containing the ethylene-alpha-olefin copolymer V.I. improver additive which are hazy and can be treated according to the invention generally contain a hazing agent derived from a dissociable metal containing material such as a metal salt of a weak organic acid. A weak organic acid has an acid moiety having a pK of more than about 3.8 usually a pK of 4 to 8. The hazing agent typically has a particle size of from about 0.01 microns to about 15 microns and is present in a concentration of less than 1 wt. %, more usually less than 0.1 wt. % based on the weight of the composition. The amount of the hazing materials present in the oil compositions is generally dependent upon the amount of copolymer viscosity index improver which these compositions contain. Generally, however, this amount is less than about 1 wt. % based on the weight of the composition.

These metals which are found to contribute to haze include the alkaline earth metals, zinc, sodium, potassium, aluminum, vanadium, chromium, iron, manganese, cobalt, nickel, cadmium, lead, bismuth and antimony. Such metals which develop the haze can come from a variety of sources during the manufacture of the ethylene-alpha-olefin copolymer including the catalyst, impurities developed during mechanical processing of the ethylene-alpha-olefin copolymer and from dispersants used to maintain the copolymer in dispersion or suspension while stored during subsequent processing or awaiting shipping. It is generally possible to filter out those haze contributing particles which have a particle size greater than about 15 microns. At lesser sizes, it has been found that the haze producing impurity is difficult if not impossible to filter so that it is optimally treated according to this invention.

It is useful to carry out the process of the instant invention by first treating the ethylene-alpha-olefin copolymer containing oil composition, e.g., an oil concentrate composition, with the hydrocarbyl substituted succinic acid in an amount effective to reduce or substantially eliminate the haze of said oil compositions and thereafter filtering out the large process debris or insoluble particulate matter. The amount of hydrocarbyl substituted succinic acid which is effective to reduce or substantially eliminate the haze, i.e., a haze reducing or eliminating effective amount, is any amount which is effective to reduce or preferably eliminate the haze of said oil compositions. Generally, this amount is within the range of from about 0.001 to about 10 weight percent, preferably from about 0.01 to about 1 weight percent, and more preferably from about 0.05 to about 0.3 weight percent based upon the total weight of the oil composition solution.

It is to be understood that only one hydrocarbyl substituted succinic acid may be used or a mixture of two or more different hydrocarbyl substituted succinic acids may be employed.

The treatment of the haze containing ethylene-alpha-olefin copolymer oil composition is carried out at a temperature of from about room temperature to about 250° C., preferably from about 50° to about 160° C., and for a time period of about 0.1 hour up to about 20 hours, preferably from 0.5 to about 2 hours. There is no need to carry out the treatment under pressure. This makes it possible to conduct the process of the invention in an open vessel in the presence of air or inert gas wherein the amount of haze treating agent, i.e., the oil-soluble strong acid is added with stirring. It is useful to blend ethylene copolymer solutions containing the anti-hazing amount of oil-soluble hydrocarbyl substituted succinic acid with zinc dialkyldithiophosphate in the presence of a diluent oil for additive concentrate applications To stabilize the zinc dialkyldithiophosphate systems, e.g. 1 to 10 volume % of zinc di($C_4$–$C_5$ alkanol)dithiophosphate in diluent mineral oil, against hydrolysis, it is necessary to add 0.01 to 0.1 wt. % amine phosphate, such as di-$C_{13}$-Oxo hydrogen acid phosphate neutralized with a diamine, e.g., n-propylstearyl diamine (see U.S. Pat. No. 3,826,745).

The ethylene-alpha-olefin copolymers treated with the hydrocarbyl substituted succinic acid find their primary utility in lubricating oil compositions, particularly lubricating oil concentrate compositions, as viscosity index improver additives. These lubricating oil compositions employ a base oil in which these additives are dissolved. Normally these additives are added to the lubricating oil composition in the form of a lubricating oil concentrate composition containing a lube oil and from about 0.01 to about 50, preferably from about 1 to about 50, and more preferably from about 2 to about 30 wt. % of said ethylene-alpha-olefin copolymer additive and from about 0.001 to about 10, preferably from about 0.01 to about 1, and more preferably from about 0.05 to about 0.3 wt. % of hydrocarbyl substituted succinic acid, and said oil concentrates are then added to an oil composition to form the formulated oil composition, e.g., SAE 10W-40 lube oil composition. These lubricating oil concentrates may also optionally contain other additives as hereinafter described.

The fully formulated lubricating oil compositions normally contain a viscosity index improving amount of the ethylene-alpha-olefin copolymer viscosity index improvers. By viscosity index improving amount is meant any amount which improves the viscosity index of the oil, such as lubricating oil, composition. Generally, this amount is from about 0.01 to 20 wt. %, preferably from 0.1 to about 15 wt. %, based on the weight of said lubricating oil composition, of the viscosity index improvers of the present invention.

Such base oils may be natural or synthetic although the natural base oils will derive a greater benefit.

Thus, base oils suitable for use in preparing lubricating oil concentrates and compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing viscosity index modifier additives of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

Thus, the additives of the present invention may be suitably incorporated into synthetic base oils such as alkyl esters of dicarboxylic acids, polyglycols and alcohols, polyalpha-olefins, alkyl benzenes, organic esters of phosphoric acids, polysilicone oils, etc.

Natural base oils include mineral lubricating oils which may vary widely as to their crude source, e.g., whether paraffinic, naphthenic, mixed, paraffinic-naphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic , naphthenic, asphaltic, or mixed base crudes, or, if desired, various blends oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, molecular sieves, etc.

The lubricating oil base stock conveniently has a viscosity of typically about 2.5 to about 12, and preferably about 2.5 to about 9 cSt at 100° C.

Thus, the additives of the present invention can be employed in a lubricating oil concentrate composition or fully formulated lubricating oil composition which comprises lubricating oil, typically in a major amount, and (i) the viscosity index improver additive, typically in a minor amount, which is effective to impart improved viscometric properties, relative to the absence of the additive, and (ii) an anti-haze effective amount of the hydrocarbyl substituted succinic acid. Additional conventional additives selected to meet the particular requirements of a selected type of lubricating oil concentrate composition or fully formulated lubricating oil composition can be included as desired.

The additives of this invention, i.e., ethylene-alpha-olefin copolymer and hydrocarbyl substituted succinic acid are oil-soluble, dissolvable in oil with the aid of a suitable solvent , or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed.

Accordingly, while any effective amount of the multifunctional viscosity index improver additives can be incorporated into the lubricating oil composition, it is contemplated that such effective amount be sufficient to provide said lube oil composition with an amount of the additive of typically from about 0.01 to about 20 e.g., 0.1 to 10, and preferably from about 0.1 to about 15 wt. %, based on the weight of said composition.

The lubricating oil base stock for the additives of the present invention typically is adapted to perform a selected function by the incorporation of additives therein to form lubricating oil compositions (i.e., formulations).

Representative additives typically present in such formulations include other viscosity modifiers, corrosion inhibitors, oxidation inhibitors, friction modifiers, dispersants, anti-foaming agents, anti-wear agents, pour point depressants and the like.

Viscosity modifiers impart high and low temperature operability to the lubricating oil and also impart thereto acceptable viscosity or fluidity at low temperatures.

Viscosity modifiers are generally high molecular weight hydrocarbon polymers including polyesters. The viscosity modifiers may also be derivatized to include other properties or functions, such as the addition of dispersancy properties.

These oil soluble viscosity modifying polymers will generally have number average molecular weights of from 10,000 to 50,000, preferably 20,000 to 200,000, e.g., 20,000 to 250,000, as determined by gel permeation chromatography or membrane osmometry.

Representative examples of suitable viscosity modifiers are any of the types known to the art including polyisobutylene, polymethacrylates, methacrylate copolymers, copolymers of an unsaturated dicarboxylic acid and vinyl compound and interpolymers of styrene and acrylic esters.

Corrosion inhibitors, also known as anti-corrosive agents, reduce the degradation of the metallic parts contacted by the lubricating oil composition. Illustrative of corrosion inhibitors are zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. % of a sulfide of phosphorus for ½ to 15 hours, at a temperature in the range of 150° to 600° F. Neutralization of the phosphosulfurized hydrocarbon may be effected in the manner taught in U.S. Pat. No. 1,969,324.

Oxidation inhibitors reduce the tendency of mineral oils to deteriorate in service which deterioration is evidenced by the products of oxidation such as sludge and varnish-like deposits on the metal surfaces. Such oxidation inhibitors include alkaline earth metal salts of alkylphenolthioesters having preferably $C_5$ to $C_{12}$ alkyl side chains, e.g., calcium nonylphenol sulfide, barium t-octylphenyl sulfide, dioctylphenylamine, phenylalphanaphthylamine, phosphosulfurized or sulfurized hydrocarbons, etc.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutyenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses scarboxyalkylene hydro-carbyl succinimide, Scarboxyalkylene hydrocarbyl succinamic acid and mixtures thereof; U.S. Pat. No. 3,879,306 which discloses N-(hydroxyalkyl)alkenyl-succinamic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobis alkanols such as described in U.S. Pat. No. 4,344,853, disclosure of this patent also being herein incorporated by reference.

Dispersants maintain oil insolubles, resulting from oxidation during use, in suspension in the fluid thus preventing sludge flocculation and precipitation or deposition on metal parts.

Pour point depressants lower the temperature at which the fluid will flow or can be poured. Such depressants are well known. Typically of those additives which usefully optimize the low temperature fluidity of the fluid are $C_8$–$C_{18}$ dialkylfumarate vinyl acetate copolymers, polymethacrylates, and wax naphthalene. Foam control can be provided by an antifoamant of the polysiloxane type, e.g., silicone oil and polydimethyl siloxane.

Anti-wear agents, as their name implies, reduce wear of metal parts. Representatives of conventional anti-wear agents are zinc dialkyldithiophosphate, zinc diaryldithiosphate and magnesium sulfonate.

Detergents and metal rust inhibitors include the metal salts of sulphonic acids, alkyl phenols, sulfurized alkyl phenols, alkyl salicylates, naphthenates and other oil soluble mono- and dicarboxylic acids. Highly basic (viz, overbased) metal salts, such as highly basic alkaline earth metal sulfonates (especially Ca and Mg salts) are frequently used as detergents. Representative examples of such materials, and their methods of preparation, are found in co-pending Ser. No. 754,001, filed July 11, 1985, the disclosure of which is hereby incorporated by reference.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | Broad Wt. % a.i. | Preferred Wt. % a.i. |
|---|---|---|
| Viscosity Modifier | .01–20 | .01–15 |
| Corrosion Inhibitor | 0.01–5 | .01–1.5 |
| Oxidation Inhibitor | 0.01–1 | .01–1.5 |
| Dispersant | 0.1–20 | 0.1–8 |
| Pour Point Depressant | 0.01–5 | .01–1.5 |
| Anti-Foam Agents | 0.001–3 | .001–0.15 |
| Anti-Wear Agents | 0.001–5 | .001–1.5 |
| Friction Modifiers | 0.01–5 | .01–1.5 |
| Detergents/Rust Inhibitors | .01–20 | .01–3 |
| Mineral Oil Base | Balance | Balance |

The following examples illustrate more clearly the present invention. These examples are presented by way of illustration and are not to be interpreted as specific limitations of the invention. In the examples, unless otherwise indicated, all parts and percentages are on a weight basis.

This examples illustrates the preparation of an ethylene-propylene copolymer V.I. improver of the instant invention.

EXAMPLE 1

An ethylene-propylene copolymer having an ethylene content of about 56 wt. %, an $\overline{M}_w$ of 180,000, a $\overline{M}_z/\overline{M}_w$ of 1.15, and a $\overline{M}_w/\overline{M}_n$ of 1.34 is prepared in a tubular reactor under the following conditions:

| | |
|---|---|
| Reactor Inlet Temp. (°C.) | −1.3 |
| Reactor Outlet Temp. (°C.) | 41.2 |
| Sidestream Feed Temp. (°C.) | −18 |
| Catalyst Premix Temp. (°C.) | 2.5 |
| Catalyst Premix Time (Sec.) | 7.8 |
| Reactor Residence Time (Sec.) at Sidestream 1/2/3/4/5 | 48/1.57/1.72/1.87/2.04 |
| Inlet Feed Rates (lb./hr) | |
| Hexane | 177,000 |
| Ethylene | 1,080 |
| Propylene | 16,600 |
| $VCl_4$ | 34.9 |
| $Al_2(C_2H_5)_3Cl_3$ | 89.3 |
| Sweep Hexane | 5,500 |
| Sidestream Feed Rates (lb./hr) | |
| Hexane | 74,000 |
| Ethylene | 5,960 |
| Propylene | 6,900 |
| Total Hexane (lb./hr.) | 251,000 |
| Sidestream Feed Splits (wt. %) | |
| Sidestream 1/2/3/4/5 | 10.3/28.8/18.9/15.9/26.1 |

The following example falls outside the scope of the instant invention in that the composition described therein contains no hydrocarbyl substituted succinic acid. This example is presented for comparative purposes only.

EXAMPLE 2

A lubricating oil concentrate is prepared containing about 6.2 wt. % of the ethylene-propylene copolymer of Example 1 by dissolving said copolymer in S-100 Neutral mineral oil. This oil concentrate is subjected to visual inspection and is found to be hazy.

The following example illustrates a composition and process of the instant invention.

EXAMPLE 3

There are added 0.5 gram of a S-100 Neutral oil solution of dodecyl succinic acid, containing about 7 wt. % dodecyl succinic acid, to 100 grams of the oil concentrate prepared in accordance with the procedure of Example 2. The resulting mixture is heated to 60° C. with stirring and then cooled to room temperature. This treated oil concentrate is subjected to visual inspection and is found to have less haze than the oil concentrate of Example 2.

In summary the preceding examples, which teach the product and process of the invention, have demonstrated that haze reduction of ethylene copolymer viscosity index improver containing oil compositions is readily realized when such compositions are treated according to the process of this invention. Not only is the haze reduced but these compositions remain visually improved in haze reduction for periods of time usually met in the shelf life required for such oil compositions.

As earlier noted the oil additive concentrate or compositions are contemplated to be admixed with other additives such as zinc dihydrocarbyl dithiophosphate, and other conventional additives may also optionally be present including dyes, pour point depressants, anti-wear agents such as tricresyl phosphate as well as the above-mentioned zinc compound, antioxidants such as N-phenyl, alpha- naphthyl amine, tertoctylphenol sulfide, 4,4'-methylene bis(2,6-ditert-butylphenol), other viscosity index improvers such as polymethacrylates, alkyl fumarate-vinyl acetate copolymers and the like as well as ashless dispersants, detergents, etc.

What is claimed is:

1. A process of reducing haze in a composition comprising:

(i) lubricating oil;

(ii) at least a viscosity index improving amount of copolymer of ethylene and at least one other alpha-olefin monomer, said copolymer comprising intramolecularly heterogeneous and intermoleculary homogeneous copolymer chains containing at least one crystallizable segment of methylene units and at least one low crystallinity ethylene-alpha-olefin copolymer segment, wherein said at least one crystallizable segment comprises at least about 10 weight percent of said copolymer chain and contains at least about 57 weight percent ethylene, wherein said low crystallinity segment contains not greater than about 53 weight percent ethylene, and wherein said copolymer has a molecular weight distribution characterized by at least one of a ratio of $\overline{M}_w/\overline{M}_n$ of less than 2 and a ratio of $\overline{M}_z/\overline{M}_w$ less than 1.8, and wherein at least two portions of an individual intramolecularly heterogeneous chain, each portion comprising at least 5 weight percent of said chain, differ in composition from one another by at least 7 weight percent ethylene;

(iii) a haze forming amount of an oil insoluble haze forming material resulting from the manufacture or finishing processes of said ethylene-alpha-olefin copolymer;

(ii) which process comprises adding to said composition a haze-reducing effective amount of at least one hydrocarbyl substituted succinic acid.

2. The process of claim 1 which comprises treating said composition with hydrocarbyl substituted succinic acid to thereby decrease haze.

3. The process of claim 2 which comprises treating said composition with hydrocarbyl substituted succinic acid at a temperature of from room temperature to about 250° C. for a period of from about 0.1 to about 20 hours.

4. The process according to claim 1 wherein said copolymer (ii) has an intermolecular compositional dispersity such that 95 weight % of said copolymer chains have a composition 15 weight % or less different from said average ethylene composition.

5. The process according to claim 4 wherein said intermolecular compositional dispersity of said copolymer (ii) is such that 95 weight % of said copolymer chains have a composition 10 wt. % or less different from said average ethylene composition.

6. The process according to claim 1 wherein said low crystallinity segment comprises from about 20 to 53 wt. % ethylene.

7. The process according to claim 1 wherein said copolymer (ii) is characterized by a weight-average molecular weight of from about 20,000 to about 12,000,000.

8. The process according to claim 1 wherein said copolymer (ii) has a MWD characterized by at least one of a ratio of $\overline{M}_w/\overline{M}_n$ of less than about 1.5 and a ratio of $\overline{M}_z/\overline{M}_w$ of less than about 1.5.

9. The process according to claim 8 wherein said copolymer (ii) has a MWD characterized by at one of a ratio of $\overline{M}_w/\overline{M}_n$ of less than about 1.25 and a ratio of $\overline{M}_z/\overline{M}_w$ of less than about 1.2.

10. The process according to claim 9 wherein said intermolecular compositional dispersity of said copolymer (ii) is such that 95 weight % of said copolymer chains have a composition 13 weight % or less different from said average ethylene composition.

11. The process according to claim 1, wherein said (ii) has a total minimum ethylene content of about 10% on a weight basis.

12. The process according to claim 1, wherein said copolymer's (ii) chain segment sequences are characterized by at least one of the structures:

$$M - T \quad \text{(I)}$$
$$T^1 - (M - T^2)_x \quad \text{(II)}$$
$$T^1 - (M^1 - T^2)_y - M^2 \quad \text{(III)}$$

wherein x and y are each integers of 1 to 3, M comprises said crystallizable segment, T comprises said low crystallinity segment, $M^1$ and $M^2$ are the same or different and each comprises an M segment, and $T^1$ and $T^2$ are the same or different and each comprises a T segment.

13. The process according to claim 12 wherein said copolymer's (ii) segment sequences are characterized by structure I.

14. The process according to claim 12 wherein said copolymer's (ii) chain segment sequences are characterized by structure II.

15. The process according to claim 14 wherein x is one.

16. The process according to claim 15 wherein in said copolymer (ii) said $T^1$ and $T^2$ segments are of substantially the same weight-average molecular weight.

17. The process according to claim 16 wherein in said copolymer (ii) the sum of the weight average molecular weights of said $T^1$ and $T^2$ segments is substantially equal to the weight-average molecular weight of said M segment.

18. The process according to claim 12 wherein said copolymer (ii) has a MWD characterized by at least one of a ratio of $\overline{M}_w/\overline{M}_n$ of less than about 1.5 and a ratio of $\overline{M}_z/\overline{M}_w$ of less than about 1.5.

19. The process according to claim 18 wherein said copolymer (ii) has a MWD characterized by at least one or a ratio of $\overline{M}_w/\overline{M}_n$ of less than about 1.25 and a ratio of $\overline{M}_z/\overline{M}_w$ of less than about 1.2.

20. The process according to claim 19 wherein said copolymer (ii) has a MWD characterized by both a ratio of $\overline{M}_w/\overline{M}_n$ of less than about 1.25 and a ratio of $\overline{M}_z/\overline{M}_w$ less than about 1.2.

21. The process according to claim 1 wherein said copolymer (ii) has a total ethylene content of greater than about 35% on a weight basis.

22. The process according to claim 1 wherein said hydrocarbyl substituted succinic acid is a $C_{10}$ to about $C_{100}$ hydrocarbyl- substituted succinic acid.

23. The process according to claim 22 wherein said hydrocarbyl substituted succinic acid is a $C_{12}$ to about $C_{20}$ hydrocarbyl substituted succinic acid.

24. The process according to claim 23 wherein said hydrocarbyl substituted succinic acid is a $C_{12}$ to about $C_{18}$ hydrocarbyl substituted succinic acid.

25. The process according to claim 24 wherein said $C_{12}$ to about $C_{18}$ hydrocarbyl is a $C_{12}$ to about $C_{18}$ alkyl.

26. The process according to claim 24 wherein said $C_{12}$ to about $C_{18}$ hydrocarbyl substituted succinic acid is $C_{12}$ to about $C_{16}$ hydrocarbyl substituted succinic acid.

27. The process according to claim 26 wherein said $C_{12}$ to about $C_{16}$ hydrocarbyl is $C_{12}$ to about $C_{16}$ alkyl.

28. The process according to claim 27 wherein said $C_{12}$ to about $C_{16}$ alkyl substituted succinic acid is dodecyl succinic acid.

29. The process according to claim 1 which comprises adding from about 0.001 to about 10 weight percent, based on the weight of said composition, of said hydrocarbyl substituted succinic acid.

30. The process according to claim 29 which comprises adding from about 0.01 to about 1 weight percent of said hydrocarbyl substituted succinic acid.

31. The process according to claim 1 wherein said on is an oil concentrate.

32. The process according to claim 31 wherein said concentrate contains from about 0.01 to 50 weight percent of said copolymer (ii).

33. The process according to claim 32 wherein said concentrate contains from about 1 to about 50 weight percent of said copolymer (ii).

34. A composition comprising:

(i) lubricating oil, (ii) viscosity index improver comprising copolymer of ethylene and at least one other alpha-olefin monomer, said copolymer comprising intramolecularly heterogeneous and intermoleculary homogeneous copolymer chains containing at least one crystallizable segment of methylene units and at least one low crystallinity ethylene-alpha-olefin copolymer segment, wherein said at least one crystallizable segment comprises at least about 10 weight percent of said copolymer chain and contains at least about 57 weight percent ethylene, wherein said low crystallinity segment contains not greater than about 53 weight percent ethylene, and wherein said copolymer has a molecular weight distribution characterized by at least one of a ratio of $\overline{M}_w/\overline{M}_n$ of less than 2 and a ratio of $\overline{M}_z/\overline{M}_w$ of less than 1.8, and wherein at least two portions of an individual intramolecularly heterogeneous chain, each portion comprising at least 5 weight percent of said chain, differ in composition from one another by at least 7 weight percent ethylene;

(iii) haze forming amount of an oil insoluble haze forming material resulting from the manufacture or finishing processes of said hydrocarbon polymer; and (iv) a haze reducing effective amount of hydrocarbyl substituted succinic acid.

35. The composition of claim 34 which contains at least a viscosity index improving amount of said copolymer (II).

36. The composition of claim 34 wherein said copolymer has an intermolecular compositional dispersity such that 95 weight % of said copolymer chains have a composition 15 weight % or less different from said average ethylene composition.

37. The composition of claim 34 wherein said low crystallinity segment of said copolymer comprises from about 20 to 53 weight % ethylene.

38. The compsosition of claim 34 wherein said copolymer (ii) is characterized by a weight-average molecular weight of from about 2,000 to about 12,000,000.

39. The composition of claim 34 wherein said copolymer (ii) has a MWD characterized by both a ratio of $\overline{M}_w/\overline{M}_n$ of less than about 1.5 and a ratio of $\overline{M}_z/\overline{M}_w$ of less than about 1.5.

40. The composition of claim 39 wherein said copolymer (ii) has a MWD characterized by both a ratio of $\overline{M}_w/\overline{M}_n$ of less than about 1.25 and a ratio of $\overline{M}_z/\overline{M}_w$ of less than about 1.2.

41. The composition of claim 40 wherein said copolymer (ii) has a MWD characterized by both a ratio of $\overline{M}_w/\overline{M}_n$ of less than about 1.25 and a ratio of $\overline{M}_z/\overline{M}_w$ of less than about 1.2.

42. The copolymer of claim 39 wherein said intermolecular compositional dispersity of said copolymer is such that 95 weight % of said copolymer chains have a composition 13 weight % or less different from said average ethylene composition.

43. The composition of claim 42 wherein said low crystallinity segment of said copolymer (ii) comprises from about 30 to 50 weight % ethylene.

44. The composition of claim 34 wherein said copolymer (ii) has a total maximum ethylene content of about 90 % on a weight basis, and wherein said at least two portions of an individual chain differ in composition from one another by at least 40 weight percent ethylene.

45. The composition of claim 34 wherein said copolymer (ii) has a total minimum ethylene content of about 20% on a weight basis

46. The composition of claim 34 wherein said copolymer's chain segment sequences are characterized by at least one of the structures:

$$M - T \quad \text{(I)}$$
$$T^1 - (M - T^2)_x \quad \text{(II)}$$
$$T^1 - (M^1 - T^2)_y - M^2 \quad \text{(III)}$$

wherein x and y are each integers of 1 to 3, M comprises said crystallizable segment, T comprises said low crystallinity segment, $M^1$ and $M^2$ are the same or different and each comprises an M segment, and $T^1$ and $T^2$ are the same or different and each comprises a T segment.

47. The composition of claim 46 wherein said copolymer's (ii) chain segment sequences are characterized by structure I.

48. The composition of claim 46 wherein said copolymer's chain segment sequences are characterized by structure II.

49. The composition of claim 48 wherein x is one.

50. The composition of claim 49 wherein said $T^1$ and $T^2$ segments are of substantially the same weight average molecular weight.

51. The composition of claim 50 wherein the sum of the weight average molecular weights of said $T^1$ and $T^2$ segments is substantially equal to the weight average molecular weight of said M segment.

52. The composition of claim 47 wherein said intermolecular compositional dispersity of said copolymer (ii) is such that 95 weight percent of said copolymer chains have a composition 13 weight % or less different from said average ethylene composition.

53. The composition of claim 34 wherein said hydrocarbyl substituted succinic acid is a $C_{10}$ to about $C_{100}$ hydrocarbyl substituted succinic acid.

54. The composition of claim 53 wherein said hydrocarbyl substituted succinic acid is a $C_{12}$ to about $C_{20}$ hydrocarbyl substituted succinic acid.

55. The composition of claim 54 wherein said hydrocarbyl substituted succinic acid is a $C_{12}$ to about $C_{18}$ hydrocarbyl substituted succinic acid.

56. The composition of claim 55 wherein said $C_{12}$ to about $C_{18}$ hydrocarbyl is a $C_{12}$ to about $C_{18}$ alkyl.

57. The composition of claim 56 wherein said $C_{12}$ to about $C_{18}$ substituted succinic acid is a $C_{12}$ to about $C_{16}$ hydrocarbyl substituted succinic acid.

58. The composition of claim 57 wherein said $C_{12}$ to about $C_{16}$ hydrocarbyl is $C_{12}$ to about $C_{16}$ alkyl.

59. The composition of claim 58 wherein said $C_{12}$ to about $C_{16}$ alkyl substituted succinic acid is dodecyl succinic acid.

60. The composition of claim 34 which contains from about 0.001 to about 10 weight percent, based on the weight of said composition, of said hydrocarbyl substituted succinic acid.

61. The composition of claim 60 which contains from about 0.01 to about 1 weight percent of said hydrocarbyl substituted succinic acid.

62. The composition of claim 34 which is an oil concentrate.

63. The composition of claim 62 which contains from about 1 to a bout 50 weight percent of said copolymer (ii).

64. The composition of claim 63 which contains from about 1 to about 30 weight percent of said copolymer (ii).

* * * * *